US007316466B2

(12) United States Patent
Uwagaki et al.

(10) Patent No.: US 7,316,466 B2
(45) Date of Patent: Jan. 8, 2008

(54) MAINTENANCE MECHANISM FOR INK JET PRINTER

(75) Inventors: Hideo Uwagaki, Kyoto (JP); Ryoichi Kawai, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 377 days.

(21) Appl. No.: 10/530,525

(22) PCT Filed: Oct. 8, 2003

(86) PCT No.: PCT/JP03/12861

§ 371 (c)(1),
(2), (4) Date: Apr. 7, 2005

(87) PCT Pub. No.: WO2004/033213

PCT Pub. Date: Apr. 22, 2004

(65) Prior Publication Data

US 2006/0164460 A1 Jul. 27, 2006

(30) Foreign Application Priority Data

Oct. 8, 2002 (JP) ..... 2002-294849
Dec. 24, 2002 (JP) ..... 2002-372702

(51) Int. Cl.
*B41J 2/165* (2006.01)

(52) U.S. Cl. ..... 347/33; 347/32; 347/29

(58) Field of Classification Search ..... 347/33, 347/29, 30, 32

See application file for complete search history

(56) References Cited

U.S. PATENT DOCUMENTS 6,334,663 B1 * 1/2002 Lee ..... 347/29
6,497,473 B2 * 12/2002 Kim ..... 347/33
6,533,388 B2 * 3/2003 Toh et al. ..... 347/33
6,568,789 B2 * 5/2003 Lin et al. ..... 347/33
6,814,424 B2 * 11/2004 Park ..... 347/29

FOREIGN PATENT DOCUMENTS

JP 5-96740 A 4/1993
JP 9-309210 A 12/1997
JP 2000-233517 A 8/2000

* cited by examiner

*Primary Examiner*—Shih-Wen Hsieh
(74) *Attorney, Agent, or Firm*—Birch, Stewart, Kolasch & Birch, LLP

(57) ABSTRACT

A maintenance mechanism for an ink jet printer is configured in such a manner that a claw member (7) for locking a slide member (6) during wiping operation is swingably supported on a base member (5) which is fixed to an apparatus body so that the claw member (7) does not move to the left and right, and the claw member (7) is forced downward by guided projecting parts (6*a*) provided on the slide member (6) during a print job so that the claw member (7) does not interfere with a carriage (2) which moves back and forth along a main scanning direction across a printing area.

6 Claims, 6 Drawing Sheets

(B)

(A)

(B)

MAINTENANCE MECHANISM FOR INK JET PRINTER

TECHNICAL FIELD

The present invention relates to a maintenance mechanism for an ink jet printer which is of a type in which an ink cartridge is mounted on a carriage.

BACKGROUND ART

Conventionally, an ink jet printer of a type in which an ink cartridge is mounted on a carriage is equipped with a maintenance mechanism which performs wiping operation for cleaning a printhead of the ink cartridge and capping operation for preventing the printhead from drying out.

As a prior art example of an ink jet printer maintenance mechanism of this kind, there exists an arrangement including a movable frame for performing wiping operation and a lever which locks in a forward moving position of the movable frame, the movable frame and the lever being provided as separate members, in which the lever attached to the movable frame via a spindle which serves as a connecting member locks the movable frame at its forward moving position and unlocks the movable frame by forward and reverse rotating motion of the lever (refer to Japanese Patent Application Publication No. 1993-096740, for example).

In the maintenance mechanism described in Japanese Patent Application Publication No. 1993-096740, however, it is necessary to separately mold the lever and the movable frame with synthetic resin since the lever and the movable frame which must be provided with the lever are configured as separate members. This causes not only a remarkable increase in manufacturing cost but also an increase in the number of components, which acts as an obstacle to achieving an overall cost reduction.

As a prior art example intended to overcome this obstacle, there exists an arrangement which makes it possible to reduce the number of components by one-piece molding a lever and a movable frame which must be provided with the lever with synthetic resin (refer to Japanese Patent Application Publication No. 2000-233517, for example).

A maintenance mechanism described in Japanese Patent Application Publication No. 2000-233517 is equipped with a 2-pen type ink cartridge and configured as shown in FIGS. 6(A) and (B), for example. FIG. 6 is a diagram showing an example of a conventional ink jet printer maintenance mechanism. As shown in the Figure, ink cartridges 51 are (detachably) mounted on a carriage 52 which is slidably supported by a metal frame 61 of an apparatus body. Guided by a guide shaft 62, the carriage 52 moves back and forth along a main scanning direction to allow the ink cartridges 51 to perform a print job.

Caps 53 for capping printheads of the ink cartridges 51 and wipers 54 for wiping the printheads are held by a slide member 56. Projections 56*b* of the slide member 56 are loosely fitted in guide holes 55*b* formed in a base member 55 which is fixed to the apparatus body such that the slide member 56 can slide obliquely leftward and rightward.

A claw member 57 for locking the slide member 56 during wiping operation is swingably supported on the slide member 56 via a pivot 57*a*. The claw member 57 is always biased clockwise as illustrated by a tension spring 59, whereby the slide member 56 is biased leftward down as illustrated.

FIG. 6(A) shows a condition in which the heads of the ink cartridges 51 are capped by the caps 53. In this condition, the slide member 56 is connected to a right side portion of the carriage 52 via a slide member/carrier joint part 56*a* and pushed up to an uppermost position.

FIG. 6(B) shows a condition in which the ink jet printer has transferred to a state of performing a print job. In this condition, the slide member 56 is brought back obliquely leftward down by a tensile force exerted by the tension spring 59 and stops at a lowermost position after passing the wiper positions. At the same time, the claw member 57 moves leftward and goes into a state in which the claw member 57 does not mutually interfere with a protruding part 52*a* which is attached to a lower-right portion of the carriage 52, where the carriage 52 is allowed to move to a print position as illustrated.

When attention is given to a mutual relationship of the positions of the wipers 54 and the claw member 57 in a left/right direction (main scanning direction), it is seen that an upper-left projecting part of the claw member 57 is located at a position further to the left of the left-hand wiper 54, that is, at a position close to a sheet transport area, in the maintenance mechanism of Japanese Patent Application Publication No. 2000-233517 shown in FIG. 6. Therefore, to avoid interference between the claw member 57 and the protruding part 52*a* of the carriage 52 and between the claw member 57 and a sheet, it is necessary to place the claw member 57 farther away from the sheet transport area by a distance necessary for avoiding the interference. This causes an increase in the width of the apparatus as much as that distance.

If the upper-left projecting part of the claw member 57 is located at the same position as the wiper 54 along the left/right direction as illustrated, for example, the slide member 56 is once locked by the claw member 57 at about a mid-length position of each guide hole 55*b* in the base member 55 during wiping operation. However, since the protruding part 52*a* of the carriage 52 meshes with the projecting part of the claw member 57 and the slide member 56 is unlocked subsequently before the wipers 54 wipe entire nozzle faces of the ink cartridges 51, the wipers 54 descend obliquely leftward down together with the slide member 56, causing a risk of inadequate wiping of the nozzle faces as a consequence.

In the aforementioned structure of the conventional ink jet printer maintenance mechanism in which the claw member 57 is pivotably supported on the slide member 56, the claw member 57 is located closer to the sheet transport area than the wipers 54 during a printing process, so that it is necessary to enlarge the interval between the sheet transport area and the wipers 54. It is therefore difficult to reduce the width of the apparatus as mentioned above.

Also, an ink jet printer of a type in which an ink cartridge is mounted on a carriage has not conventionally been provided with any damper placed between a main chassis and a slide member for maintenance in a moving direction of the carriage. For this reason, an inertial force of the slide member for maintenance would be transmitted directly to the main chassis or a main body when the slide member for maintenance returns back to its original position, causing severe vibration and colliding sound.

The present invention has been made in light of such circumstances. Accordingly, it is an object of the invention to provide an ink jet printer maintenance mechanism which makes it possible to reduce apparatus width and alleviate vibration of the maintenance mechanism and colliding sound caused thereby at reversing motion of a carriage.

DISCLOSURE OF THE INVENTION

According to the present invention, means for solving the aforementioned problems is configured as explained in the following.

A maintenance mechanism for an ink jet printer for performing capping operation and wiping operation on a printhead of an ink cartridge mounted on a carriage which moves back and forth along a main scanning direction includes a base member fixed to an apparatus body, a slide member held by the aforesaid base member slidably along the main scanning direction, slide biasing means for causing the aforesaid slide member to return back to a specified position of the base member while causing the aforesaid slide member to slide, a cap and a wiper fixed to the aforesaid slide member, a claw member swingably supported on the aforesaid base member for locking the aforesaid slide member onto the aforesaid base member during the wiping operation performed by the aforesaid wiper, claw biasing means for biasing the aforesaid claw member in a direction of locking, a claw push-down projecting part provided on the aforesaid slide member for forcing the aforesaid claw member downward in contact with the aforesaid claw member, and an unlocking protruding part provided at the bottom of the aforesaid carriage, in which the aforesaid unlocking protruding part comes into contact with the aforesaid claw member as a result of a movement of the aforesaid carriage at the beginning of a printing process upon completion of the wiping operation and causes the aforesaid claw member to release the aforesaid slide member from a locked state so that the aforesaid slide member returns back to the specified position of the base member. This maintenance mechanism for the ink jet printer is characterized in that the maintenance mechanism is configured in such a manner that the aforesaid claw push-down projecting part comes into contact with the aforesaid claw member due to returning motion of the aforesaid slide member and forces the aforesaid claw member down to a position lower than the aforesaid unlocking protruding part to avoid mutual interference between the aforesaid claw member and the aforesaid carriage.

In this configuration, the claw member for securing the slide member to the base member is swingably supported on the base member during the wiping operation and the claw member is forced downward by the claw push-down projecting part of the slide member in the printing process to thereby avoid mutual interference between the claw member and the carriage. Therefore, it is possible to achieve a reduction in the width of an apparatus.

Also, a maintenance mechanism for an ink jet printer is characterized in that the position of the aforesaid claw member during the aforesaid printing process is set lower than a sheet surface.

In this configuration, the claw member stop position during the printing process is set lower than the sheet surface, so that it is possible to cause the claw member and the wiper to be positioned at a location immediately beneath the sheet. Specifically, it becomes possible to cause the position of the wiper and a sheet transport area to overlap. This makes it possible to achieve a further reduction in the width of the apparatus.

Also, a maintenance mechanism for an ink jet printer is characterized in that the maintenance mechanism is provided with a damper for preventing an inertial force of the aforesaid slide member caused by the returning motion thereof back to the aforesaid specified position from being transmitted directly to the aforesaid base member and the apparatus body.

In this configuration, the occurrence of vibration and colliding sound of the maintenance mechanism during the returning motion of the maintenance mechanism back to its original position is suppressed by the damper.

Also, a maintenance mechanism for an ink jet printer is characterized in that the aforesaid slide member is provided with a fixing part to which the aforesaid wiper and the aforesaid damper are integrally fixed.

In this configuration, the wiper and the damper are integrally fixed to the fixing part of the slide member, so that the damper can be easily installed.

Also, a maintenance mechanism for an ink jet printer is characterized in that the aforesaid damper is made of a compression spring having a shape which makes it possible to fix the aforesaid damper to the aforesaid fixing part.

In this configuration, a compression spring featuring high manufacturing efficiency and reliability of damping force is used as the damper, so that it is possible to obtain stable damping performance at low cost.

Furthermore, a maintenance mechanism for an ink jet printer is characterized in that the aforesaid wiper is made of an elastic member having a shape which makes it possible to fix the aforesaid wiper after the aforesaid damper has been fixed to the aforesaid fixing part.

In this configuration, the damper is prevented from coming off the fixing part of the slide member without increasing the number of components.

BEST MODE FOR CARRYING OUT THE INVENTION

Maintenance mechanisms for an ink jet printer according to embodiments of the present invention are now described below in detail with reference to the drawings, although the invention is not limited thereto.

Figure 1:
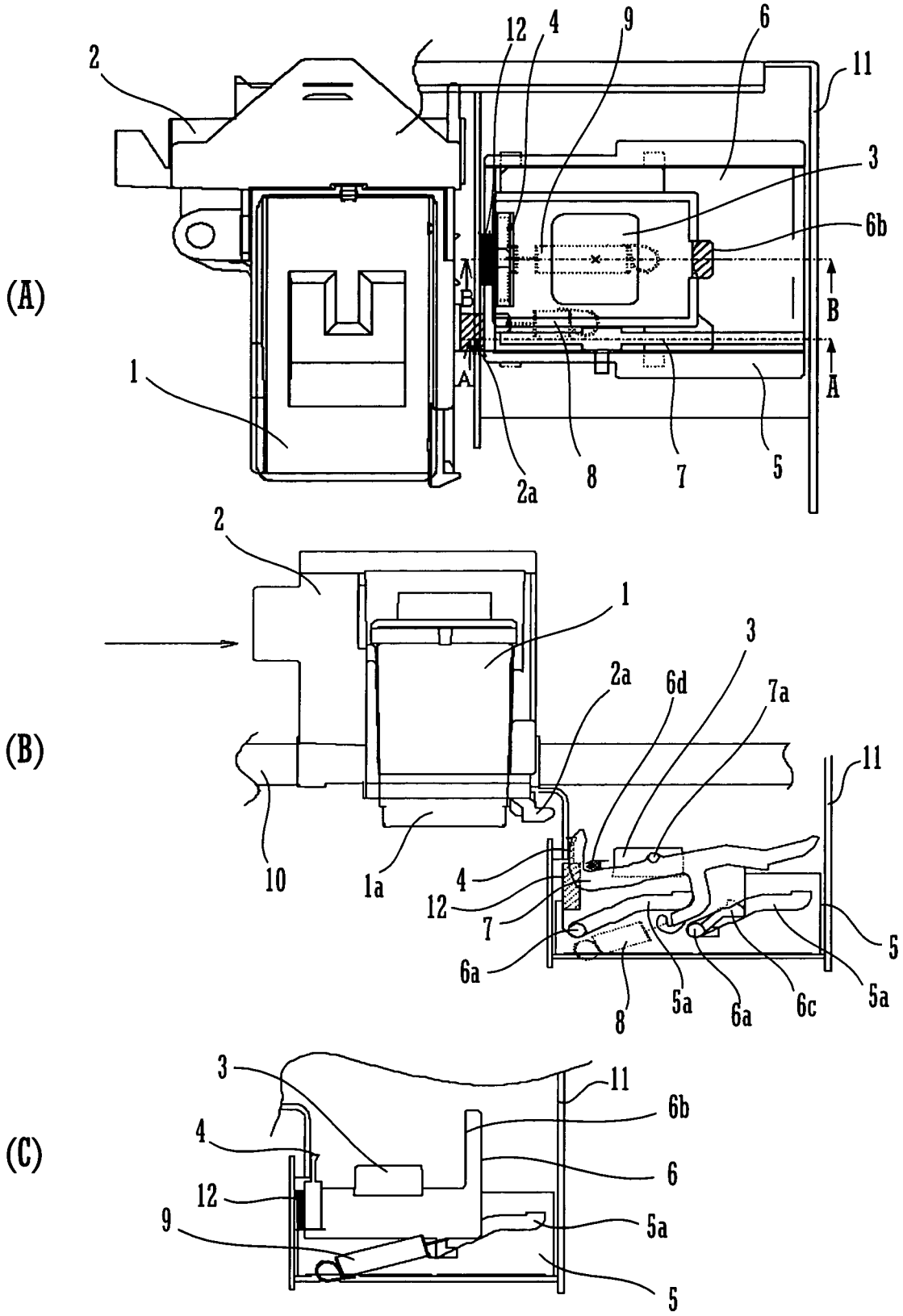
FIG. 1 is a diagram showing the basic structure of a carriage and a maintenance mechanism of an ink jet printer according to one embodiment of the present invention.
Figure 2:
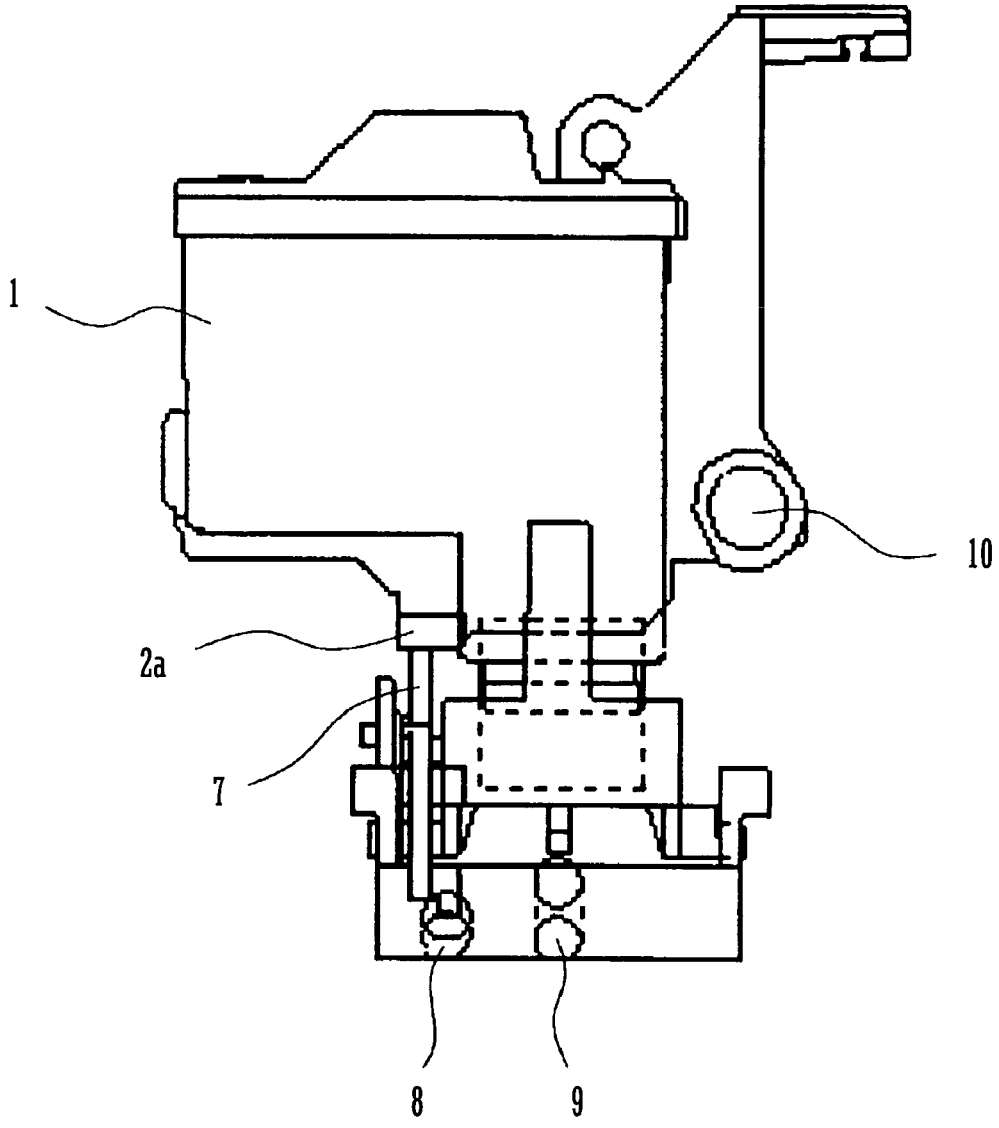
FIG. 2 is a side view of the carriage and the maintenance mechanism of the ink jet printer.

FIG. 1 is a diagram showing the basic structure of a carriage and a maintenance mechanism of an ink jet printer according to one embodiment of the present invention, in which FIG. 1(A) is a plan view showing the carriage accommodating an ink cartridge having printhead and the maintenance mechanism for wiping and capping the printhead, FIG. 1(B) is a sectional view taken along a line A-A of FIG. 1(A), and FIG. 1(C) is a sectional view taken along a line B-B of FIG. 1(A). FIG. 2 is a side view of the carriage and the maintenance mechanism shown in FIG. 1.

Referring to FIGS. 1 and 2, designated by 1 is the ink cartridge in which the 1-pen type printhead (not shown) is integrally formed. Designated by 2 is the carriage made of molded synthetic resin, for example, for carrying the ink cartridge 1. Designated by 2*a* is an unlocking protruding part jutting out downward from the bottom of the carriage 2. Designated by 3 is a cap made of an elastic material like synthetic resin, for example, for covering the printhead at a printing standby position. Designated by 4 is a wiper made of an elastic material like urethane rubber for wiping out ink, dust, etc. adhering to a surface of the printhead. Designated by 6 is a slide member equipped with the cap 3 and the wiper 4. Designated by 5 is a base member for sliding the slide member. Designated by 7 is a claw member for locking the slide member 6 onto the base member 5 while the printhead is being wiped.

In the base member 5, designated by 5*a* are guide holes formed as integral parts of the base member for guiding the slide member 6. In the slide member 6, designated by 6*a* are guided projecting parts to be guided by the guide holes 5*a*, the guided projecting parts 6*a* being integrally formed on the slide member 6, designated by 6*b* is a slide member/carriage joint part which is formed such that the carriage 2 becomes engaged with a protruding part provided underneath the carriage 2 when the carriage 2 moves to the printing standby position, and designated by 6*c* is a lock-on claw which becomes engaged with the claw member 7 to lock the slide member 6 onto the base member 5.

Designated by 8 is claw biasing means made of a tension spring mounted between the claw member 7 and the base member 5. Designated by 9 is slide biasing means made of a tension spring mounted between the slide member 6 and the base member 5. Designated by 10 is a guide shaft constructed of a stainless steel material, for example, for guiding the carriage 2 along a main scanning direction in a stable fashion. Designated by 11 is a metal frame (main chassis) constructed of a galvanized steel plate, for example, and provided in an apparatus body for accommodating constituent components of the ink jet printer. Designated by 12 is a damper constructed of a compression spring, for example, for preventing an inertial force of the slide member 6 caused by its returning motion from being transmitted directly to the base member 5.

As shown in FIGS. 1 and 2, the carriage 2 has the base member 5 having the movable slide member 6 and the guide holes 5*a* and the claw member 7 for locking the slide member 6 at the wiper position, and the cap 3 and the wiper 4 are attached to the slide member 6. Also, the base member 5 is fixed to the metal frame 11 of the apparatus body.

Fitted with the slide biasing means 9, the slide member 6 is always biased in a direction in which the slide member 6 is brought back to a specified position. On the other hand, the claw member 7 is held rotatably about the base member 5 and always biased by the tension spring 8 in such a direction that the claw is locked.

With the aforementioned structure, the carriage 2 on which the detachable ink cartridge 1 is mounted is slidably supported by the metal frame 11 provided in the apparatus body and guided by the guide shaft 10, whereby the carriage 2 performs a print job with ink spewed out of the printhead of the ink cartridge 1 while moving back and forth along the main scanning direction across a printing area.

In a maintenance area located next to the printing area, there is provided the maintenance mechanism which is described below. Specifically, the base member 5 is fixed to the apparatus body in a vertical position and the slide member 6 is held by the base member 5 in such a manner that the slide member 6 can slide along the main scanning direction of the carriage 2 and a sub scanning direction (of a sheet) (i.e., a vertical direction when the maintenance mechanism is placed in a horizontal position).

Specifically, there are formed the guide holes 5*a* extending obliquely leftward and rightward in the base member 5, and the guided projecting part 6*a* projectingly formed on the slide member 6 are loosely fitted in the guide holes 5*a* (refer to FIG. 1(B)).

The slide member 6 is always biased by the slide biasing means 9 made of a tension spring in the direction in which the slide member 6 is brought back to the specified position, and the cap 3 and the wiper 4 are provided at an upper part of the slide member 6.

The claw member 7 for locking the slide member 6 onto the base member 5 during wiping operation performed by the wiper 4 is swingably supported on the base member 5 by means of a pivot 7*a*. The claw member 7 is always biased in a direction of locking by the claw biasing means 8 made of a tension spring.

Figure 3:
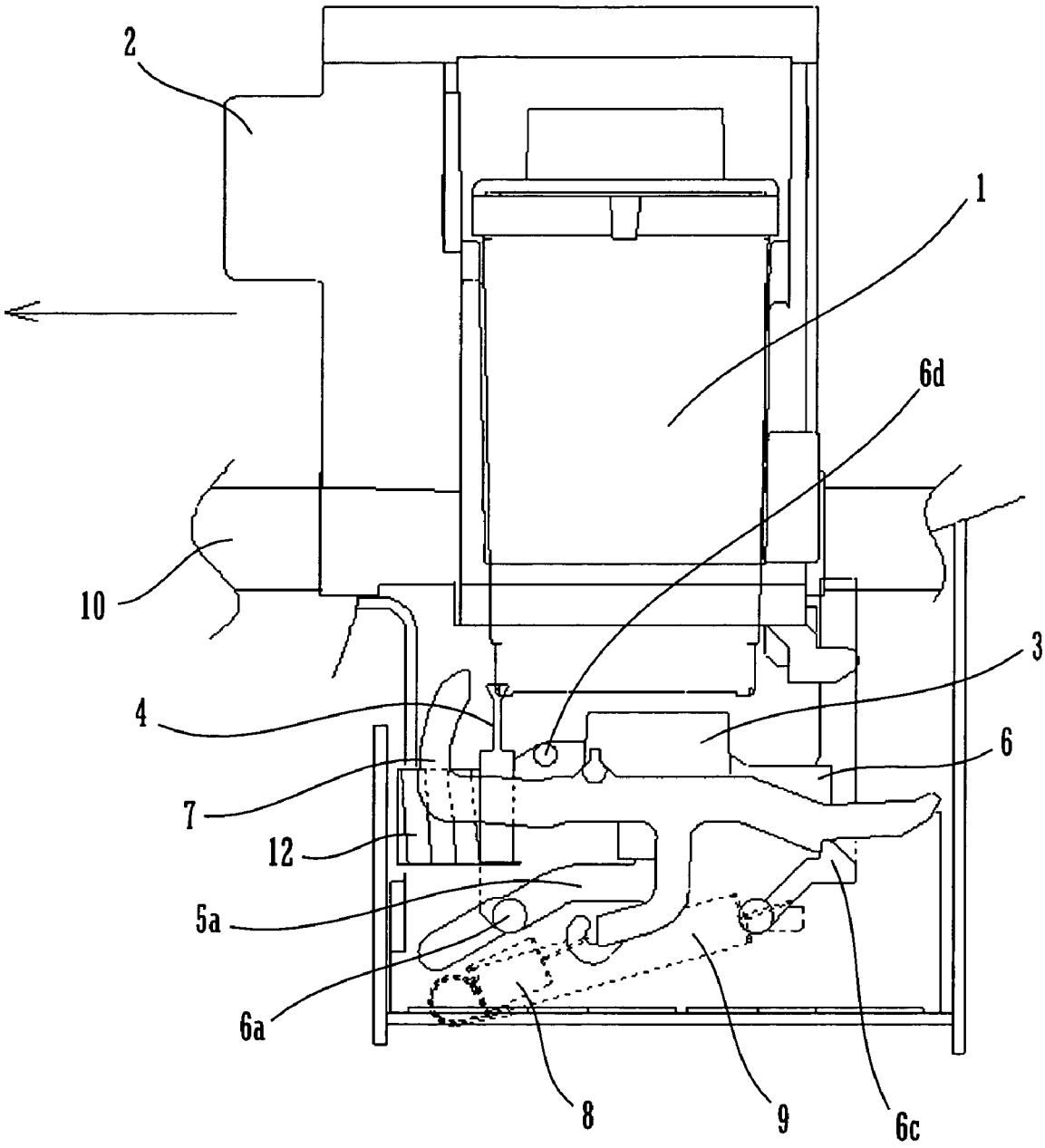
FIG. 3 is a diagram illustrating wiping operation performed by a maintenance mechanism according to the embodiment of the present invention.

With the aforementioned structure, the carriage 2, when carrying out maintenance operation upon completion of the print job performed by back-and-forth movements along the main scanning direction, goes into the maintenance area and, then, the wiper 4 performs the wiping operation to wipe the printhead (refer to FIG. 3).

The slide member 6 moves in a direction toward a sheet transport side when returning to a standby position of the slide member 6 upon completion of the wiping operation. When the slide member 6 is at the standby position, the guided projecting parts 6*a* of the slide member 6 and lower ends of the guide holes 5*a* of the base member 5 are in mutual contact, where the slide member 6 is set in a positioned state. In this state, the damper 12 is disposed between the wiper 4 and the metal frame 11 and the damper 12 is configured such that the damper 12 comes in contact with the metal frame 11. Impact is absorbed and the occurrence of colliding sound is prevented by a damping effect of the damper 12 (refer to FIG. 1(C)). It is possible to use a compression spring or sponge as the damper 12.

FIG. 3 is a diagram illustrating wiping operation performed by a maintenance mechanism according to the embodiment of the present invention, in which designated by 6*d* is a claw push-down projecting part provided on a slide member 6 for forcing a claw member 7 downward in contact with the claw member 7. When a carriage 2 moves to a right end side as shown in FIG. 3, a right end portion of the carriage 2 goes into contact with a slide member/carriage joint part 6*b*, which is disposed to project upward from a right end of the slide member 6, thereby pushing in the slide member/carriage joint part 6*b* (refer to FIG. 1(C)) rightward and forcing the slide member 6 upward up to a mid-height position.

At this time, a lock-on claw 6*c* of the slide member 6 becomes engaged with the claw member 7, the slide member 6 is locked by a base member 5 (refer to FIG. 1) and a printhead of an ink cartridge 1 which moves with the carriage 2 slides relative to a wiper 4 which is set in a fixed state, whereby wiping operation (cleaning of an ink nozzle face) is performed.

As the carriage 2 moves leftward upon completion of the wiping operation, an unlocking protruding part 2*a* formed to jut out beyond the bottom of the carriage 2 goes into contact with an upper-left projecting part of the claw member 7, thereby causing the claw member 7 to swing counterclockwise. As a consequence, the lock-on claw 6*c* unlocks the claw member 7 and the slide member 6 is released from its locked state, whereby the slide member 6 is caused to return back to a specified position, the claw member 7 is caused to swing counterclockwise by the claw push-down projecting part 6*d* projectingly formed on the slide member 6, and the aforesaid upper-left projecting part descends down to a position where the upper-left projecting part does not interfere with the unlocking protruding part 2*a* of the carriage 2 (refer to FIG. 1(B)).

Since a cap 3 and the wiper 4 have already descended below the upper-left projecting part of the claw member 7 in this state, a print job performed in a printing area by back-and-forth movements of the carriage 2 along the main scanning direction is not hindered at all and a left end of the claw member 7 does not jut out leftward beyond a right end of the carriage 2 (refer to FIG. 1(B)). Therefore, the printing area is not confined in any way by the claw member 7.

Figure 4:
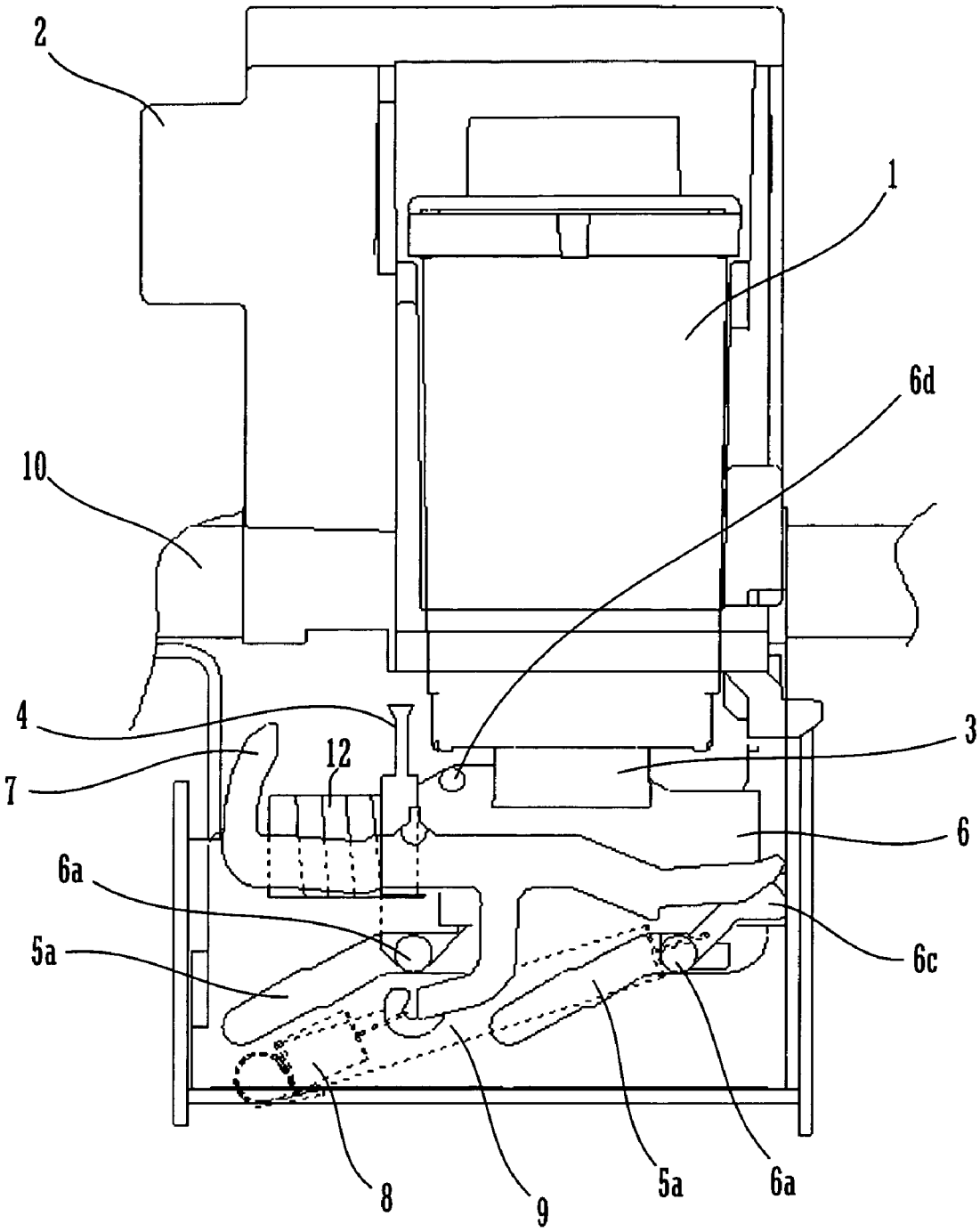
FIG. 4 is a diagram illustrating capping operation performed by the aforesaid maintenance mechanism.

FIG. 4 is a diagram illustrating capping operation performed by the maintenance mechanism according to the embodiment of the present invention. as shown in FIG. 4, During the capping operation, the right end portion of the carriage 2 goes into contact with the slide member/carriage joint part 6*b* (not shown) of the slide member 6 due to a movement of the carriage 2 toward the right end as shown in FIG. 4. As a result, the right end portion of the carriage 2 pushes in the slide member/carriage joint part 6*b* toward the right end and forces the slide member 6 upward up to an uppermost position, and the printhead (ink nozzle) of the ink cartridge 1 is capped by the cap 3.

When the ink jet printer transfers to a printing process upon releasing the cap 3 from this capped state, the carriage 2 moves leftward. Consequently, the carriage 2 is released from a state of contact with the slide member/carriage joint part 6*b* and the slide member 6 is caused to return back to the specified position by a slide biasing means 9.

Also, upon completion of the wiping operation, the cap 3 and the wiper 4 provided on the slide member 6 are at positions located below an upper end portion of the claw member 7 and a left end of the claw member 7 does not jut out beyond the right end of the carriage 2 as illustrated in FIG. 1(B). Therefore, the print job performed in the printing area by back-and-forth movements of the carriage 2 along the main scanning direction is not hindered at all by the maintenance mechanism and it becomes possible to achieve a reduction in size of the apparatus in width direction.

In other words, the claw member 7 simply makes swinging motion at the specified position relative to the slide member 6 which moves obliquely to the left and right, and the claw member 7 does not move to the left and right at all. (Conventionally, the claw member moves to the left and right together with the slide member.) In this arrangement, there exists no obstacle which confines the printing area by jutting to the left from the carriage 2 and, as a result, it becomes possible to achieve a reduction in size of the apparatus in the width direction.

Furthermore, although not illustrated, it becomes possible to cause the claw member 7 and the wiper 4 to be positioned at a location immediately beneath a sheet if the position of (the upper end portion of) the claw member 7 during the printing process is set lower than a surface of the sheet. Specifically, as it becomes possible to cause the position of the wiper 4 and a sheet transport area to overlap, it is possible to achieve a further reduction in size of the apparatus in the width direction.

Figure 5:
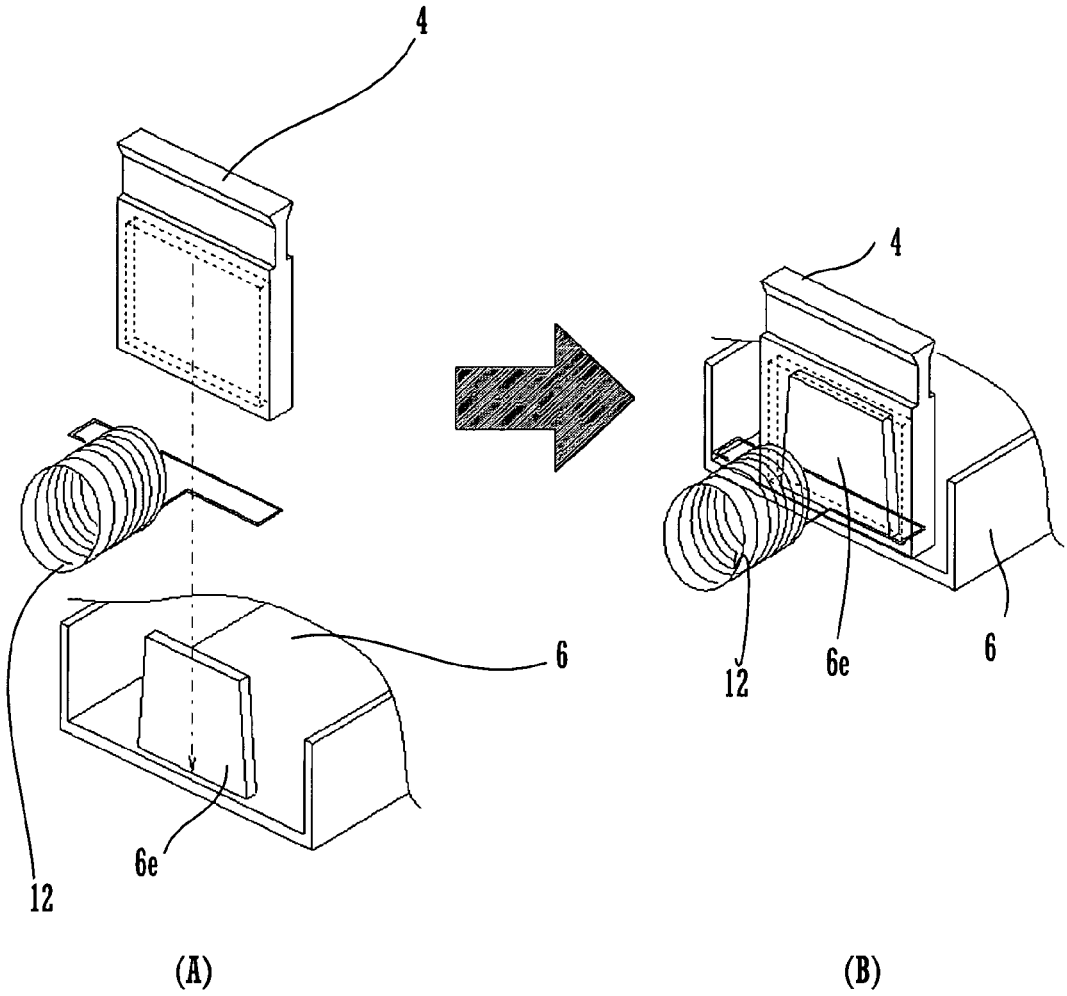
FIG. 5 is a diagram illustrating a method of fixing a damper and a wiper to a slide member according to the embodiment of the present invention.
Figure 6:
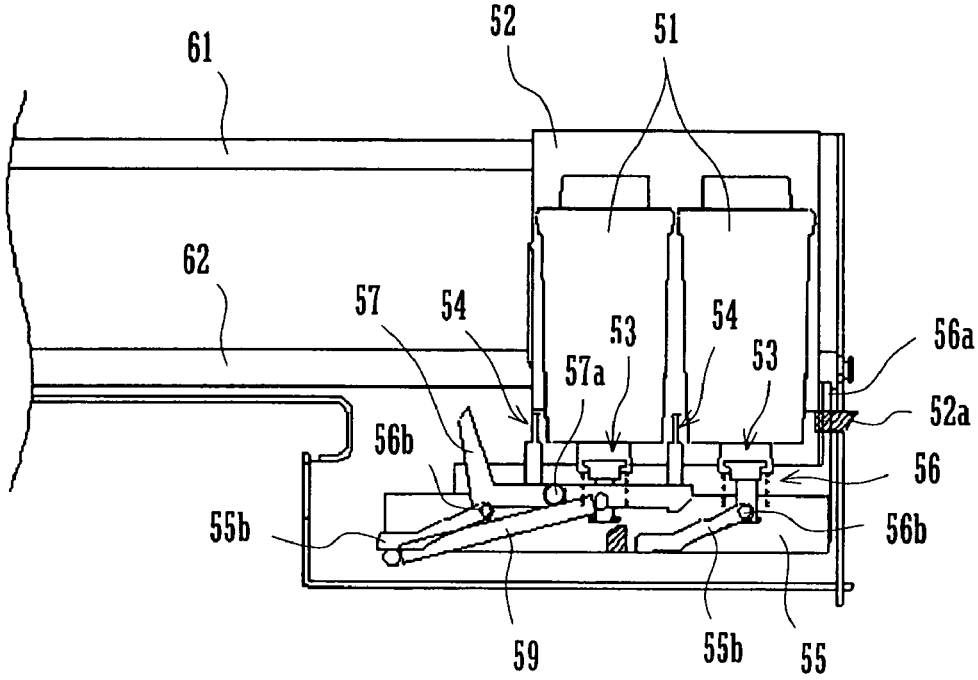
FIG. 6 is a diagram showing an example of a conventional ink jet printer maintenance mechanism.
Figure 6:
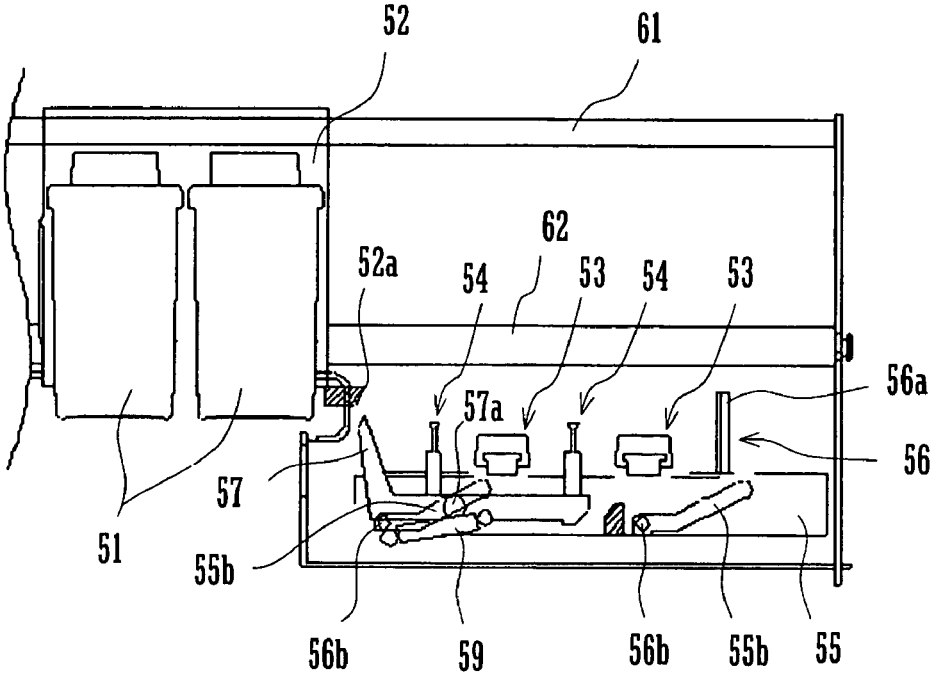

FIG. 5 is a diagram illustrating a method of fixing a damper and a wiper to a slide member according to the embodiment of the present invention, in which FIG. 5(A) shows a state before the damper and the wiper are fixed to a fixing part of the slide member, and FIG. 5(B) shows a state in which the damper and the wiper have been fixed to the fixing part of the slide member. Here, designated by 6*e* is the fixing part of the slide member 6 to which the wiper 4 and the damper 12 are fixed to form a single structure. The damper 12 is structured with a compression spring having a shape which makes it possible to fix the damper 12 to the fixing part 6*e*. Made of an elastic material, the wiper 4 has a shape which makes it possible to fix the wiper 4 after the damper 12 has been fixed to the fixing part 6*e*. Although a method of fixing the damper 12 to the side of the slide member 6 is shown in this example, the damper 12 may be fixed to the side of a metal frame 11 which faces the wiper 4.

While the invention has been described, by way of example, with reference to a so-called 1-cartridge type printer in which a single ink cartridge is mounted on a carriage in the aforementioned embodiments, the maintenance mechanism of the present invention is not limited thereto but is similarly applicable to a multi-cartridge type printer in which a plurality of ink cartridges are mounted on a carriage.

As is apparent from the foregoing discussion, the present invention exhibits the following effects:

(1) The maintenance mechanism is configured in such a manner that the claw member for locking the slide member is swingably supported by the base member so that the claw member does not move leftward and rightward during the wiping operation and the claw member does not interfere with the carriage by forcing the slide member downward during execution of the print job. As a result, the claw member does not confine the printing area and it becomes possible to achieve a reduction in size of the apparatus in width direction.

(2) If the claw member stop position during the print job is set lower than the sheet surface, it becomes possible to cause the claw member and the wiper to be positioned at a location immediately beneath the sheet and the location of the wiper and the sheet transport area to overlap. This makes it possible to achieve a further reduction in size of the apparatus in the width direction.

(3) It is possible to suppress the occurrence of vibration and colliding sound of the maintenance mechanism produced when the maintenance mechanism returns back to its original position.

(4) It is possible to integrally fix the wiper and the damper to the fixing part of the slide member and thereby facilitate work for installing the damper.

(5) It is possible to enhance the manufacturing efficiency and reliability of damping force of the damper and obtain stable damping performance at low cost.

(6) It is possible to prevent the slide member from coming off the fixing part of the slide member without increasing the number of components.

The invention claimed is:

1. A maintenance mechanism for an ink jet printer for performing capping operation and wiping operation on a printhead of an ink cartridge mounted on a carriage which moves back and forth along a main scanning direction, said maintenance mechanism comprising:

a base member fixed to an apparatus body;

a slide member held by said base member slidably along the main scanning direction;

slide biasing means for causing said slide member to return back to a specified position of the base member while causing said slide member to slide;

a cap and a wiper fixed to said slide member;

a claw member swingably supported on said base member for locking said slide member onto said base member during the wiping operation performed by said wiper;

a claw biasing member for biasing said claw member in a direction of locking;

a claw push-down projecting part provided on said slide member for forcing said claw member downward in contact with said claw member; and an unlocking protruding part provided at the bottom of said carriage, in which said unlocking protruding part comes into contact with said claw member as a result of a movement of said carriage at the beginning of a printing process upon completion of the wiping operation and causes said claw member to release said slide member from a locked state so that said slide member returns back to the specified position of the base member;

wherein said maintenance mechanism is configured in such a manner that said claw push-down projecting part comes into contact with said claw member due to returning motion of said slide member and forces said claw member down to a position lower than said unlocking protruding part to avoid mutual interference between said claw member and said carriage.

2. A maintenance mechanism for an ink jet printer as recited in claim 1, wherein the position of said claw member during said printing process is set lower than a sheet surface.

3. A maintenance mechanism for an ink jet printer as recited in claim 1, further comprising a damper for preventing an inertial force of said slide member caused by the returning motion thereof back to said specified position from being transmitted directly to said base member and the apparatus body.

4. A maintenance mechanism for an ink jet printer as recited in claim 3, wherein said slide member is provided with a fixing part to which said wiper and said damper are integrally fixed.

5. A maintenance mechanism for an ink jet printer as recited in claim 4, wherein said damper is made of a compression spring having a shape which makes it possible to fix said damper to said fixing part.

6. A maintenance mechanism for an ink jet printer as recited in claim 5, wherein said wiper is made of an elastic member having a shape which makes it possible to fix said wiper after said damper has been fixed to said fixing part.

* * * * *